US010703988B2

(12) United States Patent
Choi et al.

(10) Patent No.: US 10,703,988 B2
(45) Date of Patent: Jul. 7, 2020

(54) SYSTEM TO REMOVE SULFUR AND METALS FROM PETROLEUM

(71) Applicant: Saudi Arabian Oil Company, Dhahran (SA)

(72) Inventors: Ki-Hyouk Choi, Dhahran (SA); Ashok K. Punetha, Dhahran (SA); Muneef F. Alqarzouh, Dhahran (SA)

(73) Assignee: Saudi Arabian Oil Company (SA)

( * ) Notice: Subject to any disclaimer, the term of this patent is extended or adjusted under 35 U.S.C. 154(b) by 0 days.

(21) Appl. No.: 16/133,998

(22) Filed: Sep. 18, 2018

(65) Prior Publication Data

US 2019/0016967 A1 Jan. 17, 2019

Related U.S. Application Data

(63) Continuation of application No. 15/397,531, filed on Jan. 3, 2017, now Pat. No. 10,106,748.

(51) Int. Cl.
*C10G 31/08* (2006.01)
*C10G 25/00* (2006.01)
(Continued)

(52) U.S. Cl.
CPC ..... *C10G 31/08* (2013.01); *C10G 25/003* (2013.01); *C10G 25/06* (2013.01); *C10G 31/09* (2013.01);
(Continued)

(58) Field of Classification Search
CPC ..... C10G 31/00; C10G 31/08; C10G 25/00; C10G 25/03; C10G 25/06; C10G 45/00;
(Continued)

(56) References Cited

U.S. PATENT DOCUMENTS 4,151,068 A 4/1979 McCollum et al.
4,483,761 A 11/1984 Paspek, Jr.
(Continued)

FOREIGN PATENT DOCUMENTS

WO 2015094948 A1 6/2015

OTHER PUBLICATIONS

ASTM D. 3279-97 "Standard Test Method for n-Heptane Insolubles", American Society for Testing and Materials (2001) pp. 1-3.
(Continued)

*Primary Examiner* — Prem C Singh
*Assistant Examiner* — Brandi M Doyle
(74) *Attorney, Agent, or Firm* — Bracewell LLP; Constance G. Rhebergen

(57) ABSTRACT

A system to selectively remove metal compounds and sulfur from a petroleum feedstock includes a mixing zone configured to mix a pre-heated water stream and a pre-heated petroleum feedstock to form a mixed stream, a first supercritical water reactor configured to allow conversion reactions to occur to produce an upgraded stream, a carbon dispersal zone configured to mix carbon with a make-up water stream to produce a carbon dispersed water stream, such that the carbon is dispersed in the carbon dispersed water stream, a make-up mixing zone configured to combine the upgraded stream and the carbon dispersed water stream to produce a diluted carbon dispersed stream, the carbon is operable to trap metals present in the upgraded stream, and a second supercritical water reactor configured to allow conversion reactions to occur to produce a carbon dispersed effluent stream.

10 Claims, 4 Drawing Sheets

(51) Int. Cl.

| | |
|---|---|
| ***C10G 25/06*** | (2006.01) |
| ***C10G 31/09*** | (2006.01) |
| ***C10G 45/26*** | (2006.01) |
| ***C10G 53/02*** | (2006.01) |
| ***C10G 53/08*** | (2006.01) |
| ***C10G 65/04*** | (2006.01) |

(52) U.S. Cl.
CPC ..... *C10G 45/26* (2013.01); *C10G 53/02* (2013.01); *C10G 53/08* (2013.01); *C10G 65/04* (2013.01); *C10G 2300/202* (2013.01); *C10G 2300/205* (2013.01); *C10G 2300/80* (2013.01); *C10G 2300/805* (2013.01)

(58) Field of Classification Search
CPC ..... C10G 45/26; C10G 47/00; C10G 47/32; C10G 49/00; C10G 49/18; C10G 53/00; C10G 53/02; C10G 53/08; C10G 65/00; C10G 2300/202; C10G 2300/205; C10G 2300/80; C10G 2300/805; C10G 25/003; C10G 65/04; B01J 3/00; B01J 3/008; B01J 8/00; B01J 8/0015; B01J 8/008; B01J 8/18; B01J 8/1872
See application file for complete search history.

(56) References Cited

U.S. PATENT DOCUMENTS

| | | | | |
|---|---|---|---|---|
| 4,818,370 | A | 4/1989 | Gregoli et al. | |
| 4,840,725 | A | 6/1989 | Paspek | |
| 5,358,646 | A | 10/1994 | Gloyna et al. | |
| 5,611,915 | A | 3/1997 | Siskin et al. | |
| 5,695,632 | A | 12/1997 | Brons et al. | |
| 7,264,710 | B2 | 9/2007 | Hokari et al. | |
| 7,842,181 | B2 | 11/2010 | Choi | |
| 8,367,425 | B1 | 2/2013 | Schabron et al. | |
| 8,535,518 | B2 | 9/2013 | Choi et al. | |
| 2002/0162332 | A1 | 11/2002 | Hazlebeck | |
| 2003/0168381 | A1 | 9/2003 | Hokari et al. | |
| 2004/0232046 | A1 | 11/2004 | Tanaka et al. | |
| 2005/0040081 | A1 | 2/2005 | Takahashi et al. | |
| 2005/0177013 | A1 | 8/2005 | Countz | |
| 2006/0011511 | A1* | 1/2006 | Hokari | B01J 3/008 208/106 |
| 2007/0289898 | A1 | 12/2007 | Banerjee | |
| 2008/0099374 | A1 | 5/2008 | He et al. | |
| 2008/0099378 | A1* | 5/2008 | He | C10G 31/00 208/264 |
| 2008/0105595 | A1* | 5/2008 | Koseoglu | C10G 25/00 208/91 |
| 2008/0135454 | A1 | 6/2008 | Choi | |
| 2009/0159498 | A1 | 6/2009 | Chinn et al. | |
| 2009/0166261 | A1 | 7/2009 | Li et al. | |
| 2009/0166262 | A1 | 7/2009 | He et al. | |
| 2009/0206007 | A1 | 8/2009 | Allam | |
| 2010/0189610 | A1 | 7/2010 | Allam | |
| 2011/0147266 | A1 | 6/2011 | Choi | |
| 2011/0163011 | A1 | 7/2011 | Yarbro et al. | |
| 2011/0198085 | A1 | 8/2011 | O'Brien | |
| 2011/0266115 | A1 | 11/2011 | Berkowitz et al. | |
| 2011/0297506 | A1 | 12/2011 | Choi et al. | |
| 2011/0315600 | A1 | 12/2011 | Choi et al. | |
| 2012/0060418 | A1 | 3/2012 | Epstein et al. | |
| 2012/0061294 | A1 | 3/2012 | Choi et al. | |
| 2012/0132566 | A1 | 5/2012 | Janssen et al. | |
| 2012/0138510 | A1 | 6/2012 | Choi et al. | |
| 2012/0181217 | A1 | 7/2012 | Choi et al. | |
| 2013/0140214 | A1 | 6/2013 | Choi | |
| 2013/0313162 | A1 | 11/2013 | Choi et al. | |
| 2015/0239743 | A1* | 8/2015 | Despen | C01B 32/366 210/694 |
| 2015/0284642 | A1* | 10/2015 | Koseoglu | C10G 27/00 208/391 |
| 2016/0304791 | A1 | 10/2016 | O'Rear et al. | |
| 2016/0312129 | A1 | 10/2016 | Choi et al. | |

OTHER PUBLICATIONS

ASTM D3053 "Standard Terminology Relating to Carbon Black" American Society for Testing and Materials; Published Jan. 2016; pp. 1-4.

Author unknown "Factsheet: Particle Properties of Carbon Black" International Carbon Black Association; date accessed Jun. 7, 2017; http://carbon-black.org/files/ICBA-Particle-CB-Factsheet-111413.pdf; pp. 1-4.

Baldwin, R. M., et al. "Coal liquefaction catalysis using iron pyrite and hydrogen sulfide", Preprints of Papers—American Chemical Society, Division of Fuel Chemistry, 27, Issued 3-4, pp. 254-260 (1982).

Partial International Search Report and Written Opinion for related PCT application PCT/U52018/012177 dated May 15, 2018.

Gray, Murray R. "Consistency of Asphaltene Chemical Structures with Pyrolysis and Coking Behavior", Energy & Fuels, 17, pp. 1566-1569 (2003).

International Search Report and Written Opinion for International Application No. PCT/US2016/056571; International Filing Date Oct. 12, 2016; Report dated Jan. 23, 2017; pp. 1-13.

Iqbal, Rashid, et al. "Unlocking current refinery constraints." Petroleum technology quarterly 13.3 (2008). pp. 31-35.

Mandal, P. C., et al. "Non-catalytic vanadium removal from vanadyl etioporphyrin (VO-EP) using a mixed solvent of supercritical water and toluene: Akinetic study", Fuel, 92, pp. 288-294 (2012).

Premovic, Pavle I., et al. "Thermal stability of the asphaltenelkerogen vanadyl porphyrins." Organic geochemistry 24.8 (1996): 801-814.

Rahmani, S., et al., "Coking Kinetics of Asphaltenes as a Function of Chemical Structure", Energy & Fuels, 17, pp. 1048-1056 (2003).

Reynold, J. G. et al., in "Petroleum Chemistry and Refining", James G. Speight (Ed.), p. 74, Table 3.5, Taylor & Francis, 1998.

Takahashi, H., et al, "Characteristics of Vanadium Removal and Coke Formation Using Supercritical Water for Heavy Oil Upgrading", Journal of the Japan Petroleum Institute, 54, (7) pp. 96-102 (2011).

* cited by examiner

SYSTEM TO REMOVE SULFUR AND METALS FROM PETROLEUM

CROSS REFERENCE TO RELATED APPLICATIONS

This application is a continuation of and claims priority from U.S. Non-Provisional application Ser. No. 15/397,531 filed on Jan. 3, 2017. For purposes of United States patent practice, this application incorporates the contents of the non-provisional application by reference in its entirety.

FIELD OF THE INVENTION

This invention relates to methods for removing sulfur and metals from petroleum residue streams. More specifically, the present invention relates to methods to remove sulfur compounds and metal compounds from petroleum-based hydrocarbon streams using supercritical water in a series of reactors maintained at supercritical conditions.

BACKGROUND OF THE INVENTION

Petroleum-based hydrocarbons, such as crude oil, can be separated into four fractions based on solubility in solvents: saturate, aromatic, resin, and asphaltene. Asphaltene is not considered to be defined by a single chemical structure, but is a complicated chemical compound. FIG. 1 depicts a model structure of asphaltene from Murray R. Gray, *Consistency of Asphaltene Chemical Structures with Pyrolysis and Coking Behavior*, Energy & Fuels 17, 1566-1569 (2003). Asphaltene is defined as a fraction which is not soluble in a n-alkane, particularly, n-heptane. The other fractions, including the resin fraction, which are soluble in n-alkane, are referred to as maltene.

The asphaltene fraction contains heteroatoms, which are compounds that include sulfur, nitrogen, oxygen or metals. Many heteroatom compounds are considered impurities and the goal of the refining process is to remove those impurities.

Metals are one of the impurities targeted for removal. Metals cause problems because they can be poisonous to the refining catalysts used to remove other impurities in the petroleum-based hydrocarbons. Metals also cause corrosion problems when combusted with hydrocarbons for power generation.

Another heteroatom impurity targeted for removal is sulfur. Sulfur in the asphaltene portion can be divided into two categories: aliphatic sulfides and aromatic thiophenes. The concentration of aliphatic sulfides and aromatic thiophenes in asphalthene depends on the type of petroleum from which the asphaltene is taken. Asphaltene derived from Arabian heavy crude oil has a total sulfur content of about 7.1 weight percent sulfur, including aliphatic sulfide above 3 weight percent. In other words, about half of the sulfur contained in asphalthene from Arabian heavy crude oil is aliphatic sulfides. In contrast, asphalthene from Maya crude oil has a total sulfur content of about 6.6 weight percent sulfur, where more than half of the total sulfur content is in the form of aliphatic sulfides.

Sulfur compounds contained in the heavy fraction can be converted to lighter sulfur compounds in the light fraction through dealkylation reactions or other reactions. The ability to convert the sulfur compounds to lighter compounds depends on the bond dissociation energy of the carbon-sulfur bonds. The bond dissociation energy of the carbon-sulfur bond depends on the type of the bond. For example, aliphatic sulfides have a lower bond dissociation energy than aromatic thiophenes. A lower bond dissociation energy means the aliphatic sulfides more easily generate radicals in thermal cracking than aromatic thiophenes. In fact, aliphatic sulfides are an important precursor for initiating radical reactions in thermal processing systems such as coker units. In addition, the breaking of aliphatic sulfide bonds generates hydrogen sulfide ($H_2S$) as a main product. $H_2S$ is a known hydrogen transfer agent in radical mediated reaction networks.

Unlike the heavy crude oils, sulfur compounds in the light fraction, such as naphtha and diesel, are found as aromatic thiophenes. Aromatic thiophenes tend to be stable under thermal cracking conditions.

Sulfur compounds cause problems if released to the atmosphere and countries are imposing increasingly strict targets on the amount of sulfurs that can be released.

Current methods of addressing the presence of metals and sulfur include the use of additives and processing steps to remove the metals and the sulfurs from petroleum-based hydrocarbons. In one application, additives are injected to trap vanadium compounds in a combustor. While additives are effective to an extent, they cannot fully remove the metal compounds and therefore cannot completely prevent corrosion due to the presence of metals.

In conventional processing units, metal compounds and sulfur compounds can be removed from the crude oil itself or from its derivatives, such as refinery streams like residue streams. In a conventional hydroprocessing system, removal of impurity compounds is achieved by a hydroproces sing unit where hydrogen is supplied in the presence of a catalyst. Metal compounds decompose through reactions with hydrogen and are then deposited on the catalyst. Sulfur compounds decompose over the catalyst to produce $H_2S$. The spent catalyst with the deposited metals is then regenerated in a regeneration unit. Alternately, following a period of operation the spent catalyst can be disposed of or destroyed. Although conventional hydroprocessing can remove substantial amounts of impurities from hydrocarbon streams, the process consumes huge amounts of hydrogen and catalyst. The short catalyst lifetime and huge hydrogen consumption contribute significantly to the costs associated with operating a hydroprocessing system. Large capital expenditures required to build a hydroprocessing unit coupled with the operating costs make it difficult for power generation plants to adopt such a complicated process as a pre-treatment unit of liquid fuel.

Another process that can be used to remove metals from petroleum-based hydrocarbons is a solvent extraction process. One such solvent extraction process is a solvent deasphalting (SDA) process. An SDA process can reject all or part of the asphalthenes present in a heavy residue to produce deasphalted oil (DAO). By rejecting the asphalthenes, the DAO has lower amount of metals than that of the feed heavy residue. The high removal of metals comes at the expense of liquid yield. For example, it is possible to reduce the metal content of an atmospheric residue from an oil crude from 129 ppm by weight (wt ppm) to 3 wt ppm in an SDA process, however the liquid yield of the demetallized stream is only around 75 percent by volume (vol %).

As noted above, catalytic hydrotreating can be used to remove sulfur from streams being used as a precursor to a coker unit. Although aliphatic sulfides are more active in catalytic hydrotreating than aromatic thiophenes, the complex of asphalthene prevents active sites on the hydrotreating catalyst from accessing the aliphatic sulfides, thus a very slow reaction ensues.

Porphyrin-type metal compounds can decompose in supercritical water. For example, vanadium porphyrin is known to decompose above 400° C. through a free radical reaction. The metal compounds produced as a result of the decomposition reactions in supercritical water reactions can include oxide and hydroxide forms. The metal hydroxide or metal oxide compounds can be removed by filtering elements installed downstream of the supercritical water reactor, such as between the supercritical water reactor and a separator. However, use of filters requires high energy usage to maintain the pressure differential necessary to maintain a high pressure drop across the filtering element. This configuration is also likely to end with a loss of valuable upgraded hydrocarbons that are absorbed onto the filtering elements.

Metals can be concentrated into certain parts of the petroleum products where the carbon to hydrogen ratio is higher than in other parts. For example, the coke or coke-like parts often contain highly concentrated metals. Specifically, vanadium can be concentrated into coke when heavy oil is treated with supercritical water under coking conditions, generally at high temperatures. Thus, although coke formation could be beneficial to remove metals from liquid phase oil products, there are problems caused by coke for example process lines are plugged by coke and liquid yield decreases with an increasing amount of coke.

SUMMARY

This invention relates to methods for removing sulfur and metals from petroleum residue streams. More specifically, the present invention relates to methods to remove sulfur compounds and metal compounds from petroleum-based hydrocarbon streams using supercritical water in a series of reactors maintained at supercritical conditions.

In a first aspect of the present invention, a process to selectively remove metal compounds and sulfur from a petroleum feedstock is provided. The process includes the steps of feeding a pre-heated water stream and a pre-heated petroleum feedstock to a mixing zone, wherein the pre-heated water stream is at a temperature above the critical temperature of water and at a pressure above the critical pressure of water, wherein the pre-heated petroleum feedstock is at a temperature of less than 150° C. and at a pressure above the critical pressure of water, mixing the pre-heated water stream and the pre-heated petroleum feedstock to form a mixed stream, introducing the mixed stream to a first supercritical water reactor to produce an upgraded stream, the first supercritical water reactor at a pressure above the critical pressure of water and at a temperature above the critical temperature of water, the first supercritical water reactor in the absence of externally provided hydrogen, combining the upgraded stream and a make-up water stream in a make-up mixing zone to produce a diluted stream, wherein the make-up water stream is above the critical point, wherein the make-up water stream increases the ratio of water to oil in the diluted stream as compared to the upgraded stream, and introducing the diluted stream to a second supercritical water reactor to produce a product effluent stream, wherein the second supercritical water reactor is at a pressure lower than the pressure in the first supercritical water reactor, wherein a temperature in the second supercritical water reactor is at least the same as the temperature in the first supercritical water reactor, wherein the second supercritical water reactor is configured to allow conversion reactions to occur.

In certain aspects of the present invention, the process further includes the steps of mixing carbon with the make-up water stream in a carbon dispersal zone to produce a carbon dispersed water stream, wherein the carbon includes a carbon material, wherein the carbon is present in a range of between 0.05 wt % of petroleum feedstock and 1.0 wt % of petroleum feedstock, wherein the carbon dispersed water stream is at a temperature above the critical temperature of water and a pressure above the critical pressure of water, mixing the carbon dispersed water stream with the upgraded stream in the make-up mixing zone to produce a diluted carbon dispersed stream, wherein the carbon is dispersed in the diluted carbon dispersed stream, wherein the carbon is operable to trap metals present in the upgraded stream, introducing the diluted carbon dispersed stream to the second supercritical water reactor to produce a carbon dispersed product effluent stream, introducing the carbon dispersed product effluent stream to a filter cooling device to produce a cooled carbon dispersed effluent, wherein the cooled carbon dispersed effluent is at a temperature below 225° C., introducing the cooled carbon dispersed effluent to a filtering element to produce a used carbon and a filtered stream, wherein the filtering element is configured to separate the carbon from the cooled carbon dispersed effluent, and introducing the filtered stream to a cooling device to produce a cooled stream.

In certain aspects of the present invention, the process further includes the steps of feeding the cooled stream to a pressure let-down device to produce a depressurized stream, separating the depressurized stream in a separator unit a gas-phase product, a water-phase product and a liquid petroleum product, separating the liquid petroleum product in a hydrocarbon separator to produce a light oil product and a residue product. In certain aspects, the carbon material is selected from the group consisting of carbon black, activated carbon, and combinations of the same. In certain aspects, the carbon material includes carbon particles. In certain aspects, the carbon particles have a particle diameter of less than 10 micrometers. In certain aspects, the carbon particles have a carbon content of at least 80 wt %. In certain aspects, the process further includes the steps of cooling the reactor effluent in a cooling device to produce a cooled stream. In certain aspects, the petroleum feedstock is a petroleum-based hydrocarbon selected from the group consisting of whole range crude oil, reduced crude oil, fuel oil, refinery streams, residues from refinery streams, cracked product streams from crude oil refinery, streams from steam crackers, atmospheric residue streams, vacuum residue streams, coal-derived hydrocarbons, and biomass-derived hydrocarbons.

BRIEF DESCRIPTION OF THE DRAWINGS

These and other features, aspects, and advantages of the present invention will become better understood with regard to the following descriptions, claims, and accompanying drawings. It is to be noted, however, that the drawings illustrate only several embodiments of the invention and are therefore not to be considered limiting of the invention's scope as it can admit to other equally effective embodiments.

DETAILED DESCRIPTION OF THE INVENTION

Figure 1:
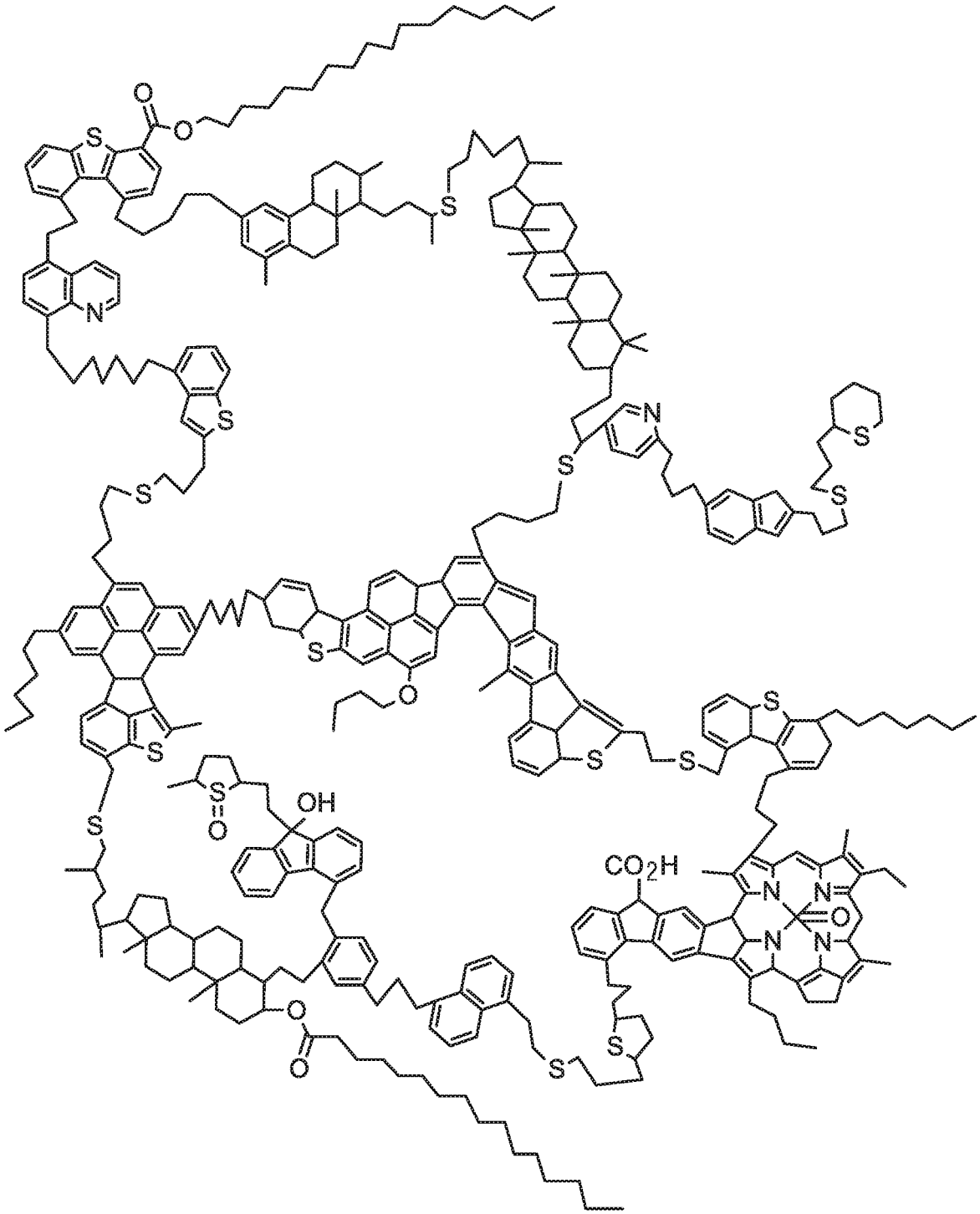
FIG. 1 depicts a model structure of asphaltene.

Although the following detailed description contains many specific details for purposes of illustration, it is understood that one of ordinary skill in the art will appreciate that many examples, variation s and alterations to the following details are within the scope and spirit of the invention. Accordingly, the exemplary embodiments of the invention described herein and provided in the appended figures are set forth without any loss of generality, and without imposing limitations, relating to the claimed invention.

The present invention provides processes and systems to produce desulfurized and demetallized streams for use in power generation or the production of high quality coke from a coker unit. The processes and systems can remove sulfur and metals from petroleum with high efficiency and without an external supply of hydrogen and with high liquid yield. The processes remove metals while reducing coke formation, minimizing generation of gas-phase product, and increasing liquid yield. In certain embodiments, the process of the present invention has a selectivity for desulfurization and demetallization in the asphaltene fraction that is very high compared to conventional hydrotreating method. In embodiments of the present invention, the process to produce a residue product stream adds value to the bottom fraction of or heavy fraction of crude oil. Streams that are useful in power generation or coker units have higher amounts of heavy fractions than most upgraded streams. It is an advantage of the present invention to produce a stream with a content of heavy fractions, but with a reduced content of sulfurs and metals.

As used herein, "external supply of hydrogen" means that the feed to the reactor is in the absence of added hydrogen, gas ($H_2$) or liquid. In other words, no hydrogen (in the form $H_2$) is a feed or a part of a feed to the supercritical water reactor.

As used herein, "external supply of catalyst" means that the feed to the reactor and the reactor itself is in the absence of added catalyst (added either as part of the feed or in the empty reactor, in other words, there is no catalyst bed in the reactor).

As used herein, "metals" or "metal compounds" refers to metal compounds found in petroleum-based hydrocarbons and can include vanadium, nickel, and iron. Metals can be concentrated in the asphaltene fraction of the hydrocarbons. Metals present can be present as porphyrin-type compounds, where the metals are bonded to nitrogen by coordinative covalent bonds or can be present as other heteroatoms.

As used herein, "heavy fraction" generally refers to the distillation residue such as atmospheric residue and vacuum residue from crude oil. Generally, the heavy fraction is considered the distillation fraction T5 (5 wt % distillation temperature in True Boiling Point (TBP)) over 650° F. (atmospheric residue) or 1050° F. (vacuum residue).

As used herein, "light oil" refers to a product stream from the supercritical water reactor having fewer heavy fractions, as compared to the feed stream to the supercritical water reactor.

As used herein, "conventional supercritical reactor" refers to a single reactor operated at supercritical conditions of water, wherein the reactants include supercritical water and a hydrocarbon stream.

Without being bound to a particular theory, it is known in the art that hydrocarbon reactions in supercritical water upgrade heavy oil to produce light oil. Supercritical water has unique properties making it suitable for use as a petroleum reaction medium where the reaction objectives include upgrading reactions, desulfurization reactions and demetallization reactions. Supercritical water is water above the critical temperature of water and above the critical pressure of water. The critical temperature of water is 373.946 degrees Celsius (° C.). The critical pressure of water is 22.06 megapascals (MPa). Supercritical water acts as both a hydrogen source and a solvent (diluent) in upgrading reactions, desulfurization reactions and demetallization reactions. Hydrogen from the water molecules is transferred to the hydrocarbons through direct transfer or through indirect transfer, such as the water gas shift reaction. Supercritical water acting as a diluent suppresses coke formation through the "cage effect." Without being bound to a particular theory, it is understood that the basic reaction mechanism of supercritical water mediated petroleum processes is the same as a radical reaction mechanism. Thermal energy creates radicals through chemical bond breakage. Supercritical water creates a "cage effect" by surrounding radicals. The radicals surrounded by water molecules cannot react easily with each other, and thus, intermolecular reactions that contribute to coke formation are suppressed. The cage effect suppresses coke formation by limiting inter-radical reactions compared to conventional thermal cracking processes, such as delayed coker. "Coke" is generally defined to be the toluene insoluble material present in petroleum.

Treatment with supercritical water can produce a light oil with greater economic value than a residue product stream. However, the absence of heavy fractions (in the light oil) reduces the available fuel for power generation and residue for coker units. Therefore, there can be advantages to having heavier fractions if the product streams are to be used in power generation or coke production.

Embodiments of the present invention are directed toward the use of at least two supercritical water reactors in series, with a make-up water stream to the second supercritical water reactor or any subsequent supercritical water reactor, that advantageously increases the heavy fractions in the product stream, while maintaining the enhanced sulfur and metal removal of a conventional supercritical reactor. The first supercritical water reactor can be operated at a lower water to oil ratio than would be expected for a supercritical water reaction. The lower water to oil ratio provides less of a hindrance to intermolecular reactions of the heavy molecules in the asphaltene fraction as compared to a supercritical water reaction. In the first supercritical water reactor, light oil is generated and metal compounds are decomposed due to cracking of heavy molecules, but heavy molecules are transformed into heavier ones by intermolecular condensation. Intermolecular condensation is avoided in conventional supercritical water reactions. In a process to produce a desulfurized stream for use in a power generation or coker unit, having an increased heavy fraction is beneficial. Due to the low water to oil ratio, the fluid in the first supercritical water reactor is going to be denser than a conventional supercritical water reactor. As an advantage, hydrogen sulfide can act as a hydrogen transfer agent more efficiently due to a higher concentration of hydrocarbons. Temperature control (control of the operating temperature) in the first supercritical water reactor is essential; because of the lower water to oil ratio the first supercritical water reactor is more vulnerable to coke formation than the second reactor with the higher water to oil ratio. Production of solid coke can potentially plug the process line.

The volumetric flow rate ratio of water to oil in the second or any subsequent supercritical water reactor is higher than in the first supercritical water reactor due to the addition of make-up water. The higher water to oil ratio in the second supercritical water reactor suppresses intermolecular condensation reactions of the heavy molecules. Additionally, the lower concentration of hydrocarbons directs reactions into intramolecular reactions such aromatization reactions, cracking reactions and isomerization reactions. Although hydrogen sulfide has a beneficial effect as a hydrogen transfer agent in the first supercritical water reactor, it can also combine with olefins to produce organic sulfur compounds, a result that can be avoided in the second supercritical water reactor as it does not decrease the sulfur content in the product stream from the second supercritical water reactor. The higher water to oil ratio in the second supercritical water reactor dilutes the hydrogen sulfide in the supercritical water and thus suppresses combination of hydrogen sulfide with olefins. Advantageously, the products of hydrogen sulfide and olefins are generally aliphatic sulfides which have a high reactivity at supercritical water conditions. Thus, the aliphatic sulfides produced in the first supercritical water reactor can be decomposed in the second supercritical water reactor at the higher water to oil ratio. To increase the dilution of hydrogen sulfide into the supercritical water, the second supercritical water reactor can be operated at a lower operating pressure than the first supercritical water reactor. A lower pressure in the second supercritical water reactor can be advantageous because it lowers the solubility of heavy molecules, such as those containing metals, causing the heavy molecules to deposit on carbon materials in the second supercritical water reactor. The absolute pressure in the first supercritical water reactor and in the second supercritical water reactor can be determined based on the process equipment requirements, so long as the difference (delta-P) between the pressure in first supercritical water reactor and the pressure in the second supercritical water reactor can be maintained, such that the pressure in the second supercritical water reactor is no more than 2 MPa less than the pressure in the first supercritical water reactor. A delta-P of greater than 2 MPa can induce sudden precipitation of heavy molecules.

The supercritical water reactors in series also have an effect on the demetallization of the petroleum stream. Metal compounds present in the petroleum feedstream begin to decompose in the first supercritical water reactor. In the second or subsequent supercritical water reactors, that are operated at a higher water to oil ratio, intermediate products from the decomposition of the metal compounds are decomposed further due to the higher water to oil ratio. The decomposed metals, which are in the form of metal oxides and metal hydroxides, are diluted by the supercritical water.

Figure 2:
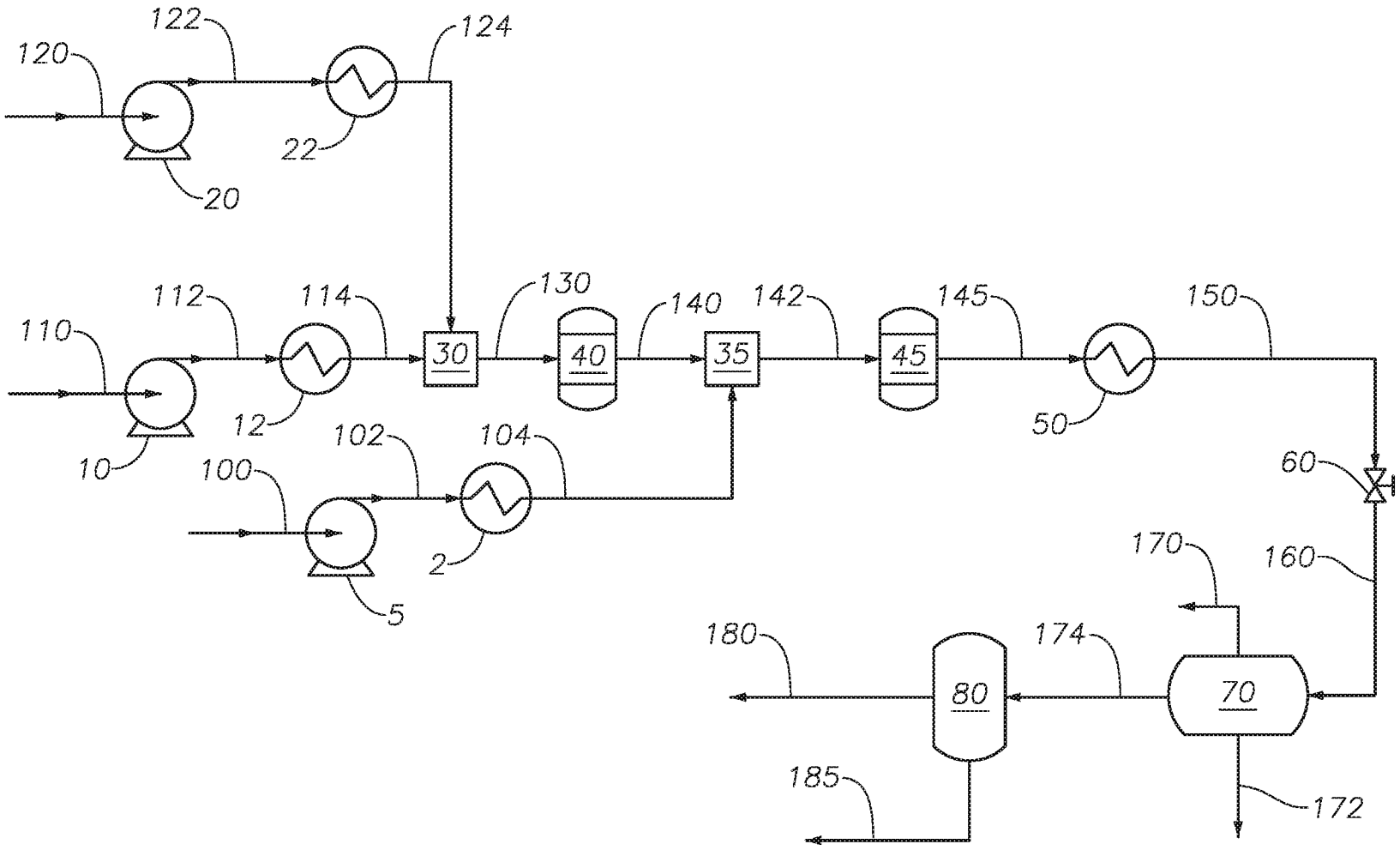
FIG. 2 provides a process diagram of one embodiment of the process of upgrading a hydrocarbon feedstock according to the present invention.

Referring to FIG. 2, a process for removing sulfur compounds and metal compounds from a petroleum feedstock is provided. Petroleum feedstock 120 is transferred to petroleum pre-heater 22 through petroleum pump 20. Petroleum pump 20 increases the pressure of petroleum feedstock 120 to produce pressurized feedstock 122. Petroleum feedstock 120 can be any source of petroleum-based hydrocarbons, including heavy fractions, having a metal content. Exemplary petroleum-based hydrocarbon sources include whole range crude oil, reduced crude oil, fuel oil, refinery streams, residues from refinery streams, cracked product streams from crude oil refinery, streams from steam crackers, including naphtha crackers, atmospheric residue streams, vacuum residue streams, bitumen, coal-derived hydrocarbons, including coal-based liquids, and biomaterial-derived hydrocarbons. In at least one embodiment of the present invention, light petroleum-based hydrocarbons, such as naphtha, that are in the absence of metal compounds or have a low metal content and are not suitable as feedstock for the present invention. In at least one embodiment of the present invention, petroleum feedstock 120 is whole range crude oil. In at least one embodiment of the present invention petroleum feedstock 120 is an atmospheric residue stream. In at least one embodiment of the present invention, petroleum feedstock 120 is a vacuum residue stream. In at least one embodiment of the present invention, petroleum feedstock 120 includes pitch separated from a petroleum-based hydrocarbon, and alternately includes tar separated from a petroleum-based hydrocarbon. In at least one embodiment of the present invention, the pitch in petroleum feedstock 120 is separated from a solvent deasphaltene (SDA) process. Atmospheric residue and vacuum residue streams are bottom streams or bottom fractions from an atmospheric distillation process or vacuum distillation process that can contain metal compounds and can be used as feedstocks for the present invention.

Pressurized feedstock 122 has a feedstock pressure. The feedstock pressure of pressurized feedstock 122 is at a pressure greater than the critical pressure of water, alternately greater than 23 MPa, and alternately between about 23 MPa and about 30 MPa. In at least one embodiment of the present invention, the feedstock pressure is 27 MPa.

Petroleum pre-heater 22 increases the temperature of pressurized feedstock 122 to produce pre-heated petroleum feedstock 124. Petroleum pre-heater 22 heats pressurized feedstock 122 to a feedstock temperature. The feedstock temperature of pre-heated petroleum feedstock 124 is a temperature below 300° C., alternately a temperature between about 30° C. and 300° C., alternately a temperature between 30° C. and 150° C., and alternately a temperature between 50° C. and 150° C. In at least one embodiment of the present invention, the feedstock temperature is 150° C. Keeping the temperature of pre-heated petroleum feedstock 124 below 350° C. reduces, and in some cases eliminates the production of coke in the step of heating the feedstock upstream of the reactor. In at least one embodiment of the present invention, maintaining the feedstock temperature of pre-heated petroleum feedstock 124 at or below about 150° C. eliminates the production of coke in pre-heated petroleum feedstock 124. Additionally, heating a petroleum-based hydrocarbon stream to 350° C., while possible, requires heavy heating equipment, whereas heating to 150° C. can be accomplished using steam in a heat exchanger.

Water stream 110 is fed to water pump 10 to create pressurized water stream 112. Pressurized water stream 112 has a water pressure. The water pressure of pressurized water stream 112 is a pressure greater than the critical pressure of water, alternately a pressure greater than about 23 MPa, and alternately a pressure between about 23 MPa and about 30 MPa. In at least one embodiment of the present invention, the water pressure is about 27 MPa. Pressurized water stream 112 is fed to water pre-heater 12 to create pre-heated water stream 114.

Water pre-heater 12 heats pressurized water stream 112 to a water temperature to produce pre-heated water stream 114. The water temperature of pressurized water stream 112 is a temperature above the critical temperature of water, alternately a temperature between about 374° C. and about 600° C., alternately between about 374° C. and about 450° C., and alternately above about 450° C. The upper limit of the water temperature is constrained by the rating of the physical aspects of the process, such as pipes, flanges, and other connection pieces. For example, for 316 stainless steel, the maximum temperature at high pressure is recommended to be 649° C. Temperatures below 600° C. are practical within the physical constraints of the pipelines. Pre-heated water stream 114 is supercritical water at conditions above the critical temperature of water and critical pressure of water.

Water stream 110 and petroleum feedstock 120 are pressurized and heated separately. In at least one embodiment of the present invention, the temperature difference between pre-heated petroleum feedstock 124 and pre-heated water stream 114 is greater than 300° C. Without being bound to a particular theory, a temperature difference between pre-heated petroleum feedstock 124 and pre-heated water stream 114 of greater than 300° C. is believed to increase the mixing of the petroleum-based hydrocarbons present in pre-heated petroleum feedstock 124 with the supercritical water in pre-heated water stream 114 in mixing zone 30. Pre-heated water stream 114 is in the absence of an oxidizing agent. Regardless of the order of mixing, petroleum feedstock 120 is not heated above 350° C. until after having been mixed with water stream 110 to avoid the production of coke.

Pre-heated water stream 114 and pre-heated petroleum feedstock 124 are fed to mixing zone 30 to produce mixed stream 130. Mixing zone 30 can include any mixer capable of mixing a hydrocarbon stream and a supercritical water stream. Exemplary mixers for mixing zone 30 include static mixers and capillary mixers. Without being bound to a particular theory, supercritical water and hydrocarbons do not instantaneously mix on contact, but require sustained mixing before a well-mixed or thoroughly mixed stream can be developed. A well-mixed stream facilitates the cage-effect of the supercritical water on the hydrocarbons. Mixed stream 130 is introduced to first supercritical water reactor 40. The ratio of the volumetric flow rates of petroleum feedstock to water entering first supercritical water reactor 40 at standard ambient temperature and pressure (SATP) is between about 1:10 and about 1:0.1, and alternately between about 1:1 and about 1:0.2. In at least one embodiment, the ratio of the volumetric flow rate of water to the volumetric flow rate of petroleum feedstock entering first supercritical water reactor 40 is in the range between 1 to 5.

In any second or subsequent supercritical water reactor, a higher ratio of the volumetric flow rate of water to the volumetric flow rate of petroleum feedstock is desired to disperse the refined petroleum portion. In any second or subsequent supercritical water reactor, additional water can be added to make the ratio of the volumetric flow rate of water to the volumetric flow rate of the refined petroleum portion greater than the ratio in the first supercritical water reactor. In at least one embodiment, the ratio of the volumetric flow rate of water to the volumetric flow rate of petroleum feedstock entering a second or any subsequent supercritical water reactor is in the range between 1.1 to 5. Using more water than oil in the fluid of the second supercritical water reactor increases the liquid yield, over processes that have a low water to oil ratio or a ratio of more oil than water. Poor mixing induces or accelerates reactions such as, oligomerization reactions and polymerization reactions, which result in the formation of larger molecules or coke. If metallic compounds such as vanadium porphyrins are embedded into such large molecules or coke, there is no way to remove the metallic compounds, unless the large molecules are subjected to a physical separation or chemical separation method. The present method advantageously increases liquid yield over processes that concentrate metals into coke and then remove the metals from liquid oil product. In addition to decreasing liquid yield, such processes that concentrate metals create problems for continuous operation, such as plugging of process lines.

Having a well-mixed mixed stream 130 increases the ability to remove metals and sulfur according to the method of the invention. Mixed stream 130 has an asphaltene fraction, a maltene fraction, and a supercritical water fraction. The fractions are well-mixed in mixed stream 130 and not as separate layers. In at least one embodiment of the present invention, mixed stream 130 is an emulsion. The temperature of mixed stream 130 depends on the water temperature of pre-heated water stream 114, the feedstock temperature of pre-heated petroleum feedstock 124, and the ratio of pre-heated water stream 114 and pre-heated petroleum feedstock 124, the temperature of mixed stream 130 can be between 270° C. and 500° C., alternately between 300° C. and 500° C., and alternately between 300° C. and 374° C. In at least one embodiment of the present invention, mixed stream 130 is greater than 300° C. The pressure of mixed stream 130 depends on the water pressure of pre-heated water stream 114 and the feedstock pressure of pre-heated petroleum feedstock 124. The pressure of mixed stream 130 can be greater than 22 MPa.

Mixed stream 130 is introduced to first supercritical water reactor 40 to produce upgraded stream 140. In at least one embodiment of the present invention, mixed stream 130 passes from mixing zone 30 to first supercritical water reactor 40 in the absence of an additional heating step. In at least embodiment of the present invention, mixed stream 130 passes from mixing zone 30 to first supercritical water reactor 40 in the absence of an additional heating step, but through piping with thermal insulation to maintain the temperature.

First supercritical water reactor 40 is operated at a temperature greater than the critical temperature of water, alternately between about 374° C. and about 500° C., alternately between about 380° C. and about 460° C., alternately between about 400° C. and about 500° C., alternately between about 400° C. and about 430° C., and alternately between 420° C. and about 450° C. In a preferred embodiment, the temperature in first supercritical water reactor 40 is between 400° C. and about 430° C. First supercritical water reactor 40 is at a pressure greater than the critical pressure of water, alternately greater than about 22 MPa, alternately between about 22 MPa and about 30 MPa, and alternately between about 23 MPa and about 27 MPa. The residence time of mixed stream 130 in first supercritical water reactor 40 is longer than about 10 seconds, alternately between about 10 seconds and about 5 minutes, alternately between about 10 seconds and 10 minutes, alternately between about 1 minute and about 6 hours, and alternately between about 10 minutes and 2 hours. Conversion reactions can occur in first supercritical water reactor 40. The conversion reactions produce a refined petroleum portion in upgraded stream 140. Exemplary conversion reactions include upgrading, demetallization, desulfurization, denitrogenation, deoxygenation, cracking, isomerization, alkylation, condensation, dimerization, hydrolysis, and hydration, and combinations thereof.

Upgraded stream 140 is fed to make-up mixing zone 35. Upgraded stream 140 is mixed with make-up water stream 104 in make-up mixing zone 35 to produce diluted stream 142. Make-up water stream 104 is above the critical temperature and the critical pressure of water. Make-up stream 100 is pressurized in make-up pump 5 to produce pressurized make-up stream 102. The pressure of pressurized make-up stream 102 is designed in consideration of the pressure in first supercritical water reactor 40 and second supercritical water reactor 45 and the pressure drop between the two reactors. The pressure of pressurized make-up stream 102 is at a pressure above the critical pressure of water. Pressurized make-up stream 102 is then fed to make-up heater 2 to heat pressurized make-up stream 102 to a temperature above the critical temperature of water to produce make-up water stream 104. Make-up mixing zone 35 can include any mixer capable of mixing a hydrocarbon stream and supercritical stream. Exemplary mixers for make-up mixing zone 35 include static mixers and capillary mixers. Make-up stream 104 is mixed with upgraded stream 140 to increase the water to oil ratio of the stream entering second supercritical water reactor 45. Diluted stream 142 is fed to second supercritical water reactor 45 to produce product effluent stream 145. The volumetric flow rate ratio of make-up water stream 104 to upgraded stream 140 is 0.1 to 100, alternately 0.5 to 10, and alternately 0.1 to 2.

Make-up stream 104 advantageously increases the water to oil ratio following first supercritical water reactor 40. The increased water to oil ratio in diluted stream 142 as compared to upgraded stream 140 makes sulfur removal in second supercritical water reactor 40. Without being bound to a particular theory it is understood that a higher water to oil ratio can dilute hydrogen sulfide, which can suppress recombination of hydrogen sulfide and olefins. Removing hydrogen sulfide from a process is easier than removing sulfur-carbon compounds. In addition, make-up stream 104 enhances asphalthene decomposition as the dilution reduces the concentration of hydrocarbons in supercritical water reactor 45. Dilution by make-up water reduces the opportunity for recombination of $H_2S$ and olefins in second supercritical water reactor 45.

Second supercritical water reactor 45 is operated at a temperature greater than the critical temperature of water, alternately between about 374° C. and about 500° C., alternately between about 380° C. and about 460° C., alternately between about 400° C. and about 500° C., alternately between about 400° C. and about 430° C., and alternately between 420° C. and about 450° C. The temperature of second supercritical water reactor 45 is chosen in consideration of the temperature in first supercritical water reactor 40, such that the temperature of second supercritical water reactor 45 is the same as the temperature in the first supercritical water reactor 40, alternately the temperature of second supercritical water reactor is at least the same as the temperature in the first supercritical water reactor 40, and alternately the temperature of second supercritical water reactor is greater than the temperature in the first supercritical water reactor 40. In at least one embodiment of the present invention, the temperature of second supercritical water reactor 45 is between about 400° C. and about 500° C. In a preferred embodiment, the temperature in second supercritical water reactor 45 is between about 420° C. and about 450° C. The pressure of second supercritical water reactor 45 is adjusted in consideration of the pressure in first supercritical water reactor 40. Second supercritical water reactor 45 is at the same pressure as first supercritical water reactor 40, and alternately at a pressure between the critical pressure of water and the pressure of first supercritical water reactor 40. The difference in pressure between first supercritical water reactor 40 and second supercritical water reactor 45 can be 2 MPa, alternately less than 2 MPa, alternately less than 1.8 MPa, alternately less than 1.6 MPa, and alternately less than 1.5 MPa.

The residence time of diluted stream 142 in second supercritical water reactor 45 is longer than about 10 seconds, alternately between about 10 seconds and about 5 minutes, alternately between about 10 seconds and 10 minutes, alternately between about 1 minute and about 6 hours, and alternately between about 10 minutes and 2 hours. Conversion reactions can occur in second supercritical water reactor 45. The conversion reactions produce a refined petroleum portion in product effluent stream 145. Exemplary conversion reactions include upgrading, demetallization, desulfurization, denitrogenation, deoxygenation, cracking, isomerization, alkylation, condensation, dimerization, hydrolysis, and hydration, and combinations thereof.

Product effluent stream 145 is fed to cooling device 50 to produce cooled stream 150. Cooling device 50 can be any device capable of cooling product effluent 145. In at least one embodiment of the present invention, cooling device 50 is a heat exchanger. Cooled stream 150 is at a temperature below the critical temperature of water, alternately below 300° C., and alternately below 150° C. In at least one embodiment of the present invention, cooled stream 150 is at a temperature of 50° C. In at least one embodiment of the present invention, cooling device 50 can be optimized to recover heat from cooling product effluent stream 145 and the recovered heat can be used in an another unit of the present process, or in another process.

Cooled stream 150 passes through pressure let-down device 60 to produce depressurized stream 160. Pressure let-down device 60 reduces the pressure of cooled stream 150 to a pressure of less than the critical pressure of water, alternately less than 5 MPa, alternately less than 1 MPa, and alternately less than 0.1 MPa.

Separator unit 70 separates depressurized stream 160 into gas-phase product 170, water-phase product 172 and liquid petroleum product 174. Gas-phase product 170 can include hydrocarbons present as gases, such as methane and ethane. Gas-phase product 170 can be released to atmosphere, further processed, or collected for storage or disposal.

Water-phase product 172 can be recycled for use as water stream 110, can be further processed to remove any impurities and then recycled for use as water stream 110, or can be collected for storage or disposal.

Liquid petroleum product 174 is introduced to hydrocarbon separator 80. Hydrocarbon separator 80 separates liquid petroleum product 174 into light oil product 180 and residue product 185. Residue product 185 has reduced metal content, reduced sulfur selectivity, and reduced metal content in the asphaltene fraction and reduced sulfur concentration in the asphaltene fraction compared with products from a conventional hydrotreating process. Residue product 185 has a metal content below 5 ppm, alternately below 1 ppm, and alternately below 0.5 ppm. Hydrocarbon separator 80 can include a fractionation process, where liquid petroleum product 174 can be separated into light oil product 180 and residue product 185 based on the boiling point of the components in the streams. Exemplary fractionation processes include distillation. In at least one embodiment of the present invention, the cut point of a fractionation or distillation process is determined based on the desired composition of light oil product 180 and residue product 185. In at least one embodiment of the present invention, where residue product 185 can be used in a power generation process, the cut point of the distillation process is adjusted to achieve a target viscosity, total metal content, a sulfur content, and a Conradson Carbon Residue (CCR) of residue product 185 for the power generation process.

In some embodiments of the present invention, residue product 185 can be combusted in a power generation process. In some embodiments of the present invention, residue product 185 can be used in a coker unit to produce solid coke. The solid coke produced in a coker unit from residue product 185 has lower sulfur and metal content than coke produced from a conventional feed to a coker unit. To produce a high grade coke, such as an anode grade coke, from a heavy hydrocarbon stream, such as a vacuum residue, a conventional feed to a coker unit has to be pre-treated in a hydrotreating unit to remove heteroatoms, which can be difficult. Therefore, many refineries prefer to use light streams, such as light crude oil, to produce high grade coke, which avoids the use of expensive hydrotreating unit. Advantageously, the present invention produces a feed stream to a coker unit from a heavy hydrocarbon stream in the absence of a hydrotreating unit in the process.

Figure 3:
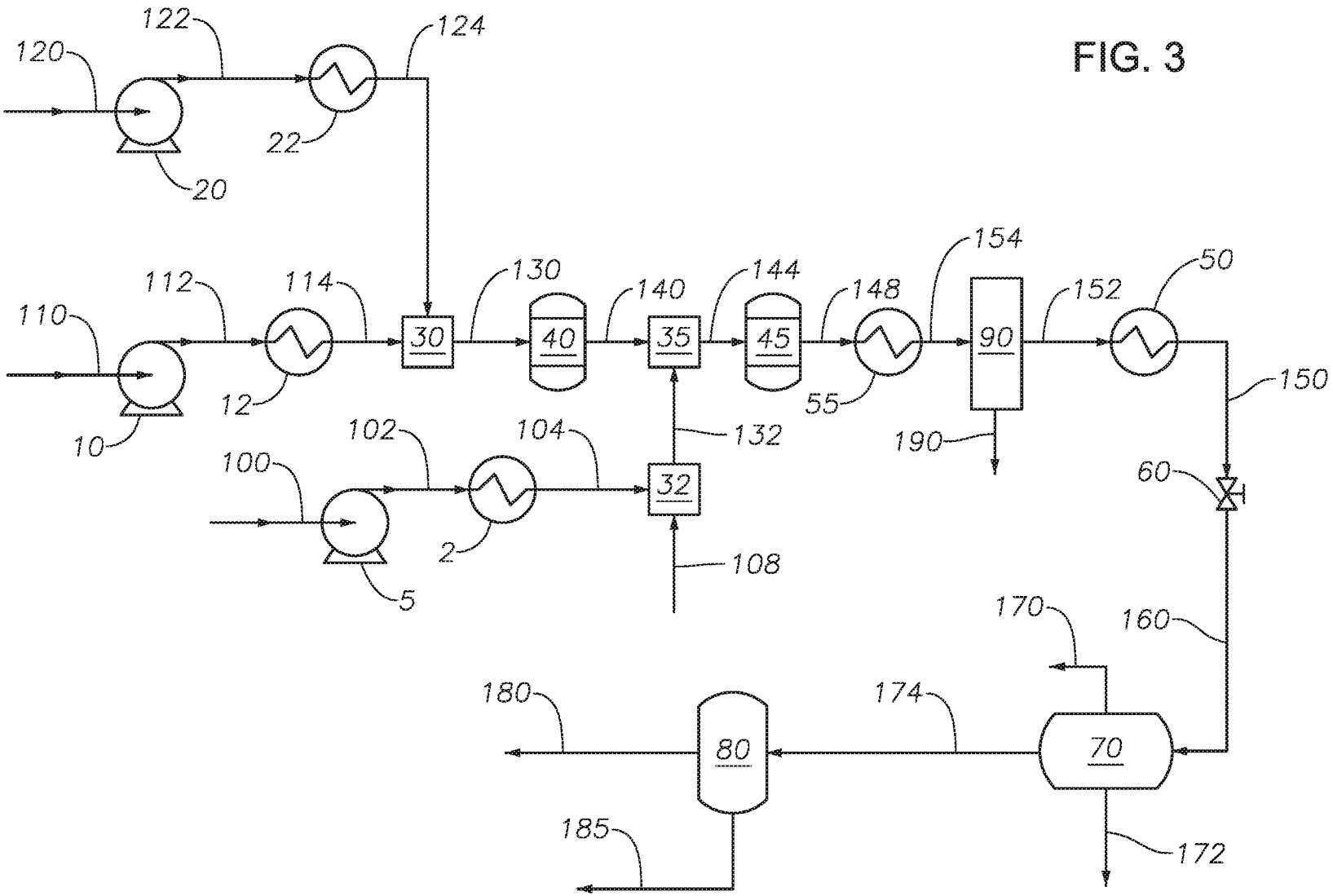
FIG. 3 provides a process diagram of one embodiment of the process of upgrading a hydrocarbon feedstock according to the present invention.

FIG. 3 discloses an alternate embodiment of the present invention. With reference to the process and method as described in FIG. 2, make-up water stream 104 is fed to carbon dispersal zone 32. The ratio of the volumetric flow rate of make-up water stream 104 to the volumetric flow rate of pre-heated water 114 is between 10:1 and 0.1:1 at standard atmospheric temperature and pressure (SATP), alternately between 10:1 and 1:1 at SATP, alternately between 1:1 and 0.1:1 at SATP, and alternately between 1:1 and 0.5:1 at SATP. In at least one embodiment, the ratio of the volumetric flow rate of make-up water stream 104 to the volumetric flow rate of pre-heated water 114 is between 1:1 and 0.5:1. The ratio of the volumetric flow rate of make-up water stream 104 to the volumetric flow rate of pre-heated water 114 is maintained in this ratio to avoid a sudden increase of total flow rate after first supercritical water reactor 40, in order to maintain stable operation of the process.

Carbon 108 is introduced to carbon dispersal zone 32. Carbon dispersal zone 32 mixes carbon 108 into make-up water stream 104 to produce carbon dispersed water stream 132. Carbon dispersal zone 32 can include any equipment capable of mixing a slurry into a liquid, alternately a liquid into a slurry, alternately a solid into a liquid, and alternately two liquids. In at least one embodiment, carbon dispersal zone 32 includes equipment capable of mixing a slurry into a liquid. In at least one embodiment, a continuous stirred tank reactor (CSTR) type vessel can be used in carbon dispersal zone 32 to mix carbon 108 into make-up water stream 104.

In at least one embodiment of the present invention, make-up water stream 104 is injected into carbon dispersal zone 32 first and then carbon 108 is injected into carbon dispersal zone 32.

Carbon 108 can include any type of carbon material that is stable at supercritical water reactor conditions and that can trap metals, including vanadium, in the asphaltene fraction. In at least one embodiment, carbon 108 can be a paste or slurry made from mixing carbon material in water, for ease of transferring through the piping. In at least one embodiment, the paste has a weight ratio of carbon material to water of 1 to 1. The paste can be prepared by a ball milling process. A surfactant can be added during the ball milling process.

In at least one embodiment, the metals can be produced from the decomposition of metal compounds in first supercritical water reactor 40. As used herein, "trap" means to catch or hold the metals, such that the metals are deposited on the carbon material. The role of the carbon material is to trap metal compounds that have low solubility in supercritical water condition, such as asphaltene-like compounds. Without being bound to a particular theory, the aliphatic carbon-sulfur bonds and the aliphatic carbon-carbon bonds are broken as a result of the cracking of asphaltene from petroleum feedstock 120 in first supercritical water reactor 40, producing asphaltene-like compounds. The asphaltene-like compounds have a lower molecular weight than asphaltenes, even though they can contain metal. Advantageously, the lower molecular weight asphaltene-like compounds are deposited on the carbon material due to the reduced solubility of the asphaltene-like compounds in second supercritical water reactor 45 caused by the lower pressure in second supercritical water reactor 45. The carbon materials have high aromaticity on their surface, which induces adsorption of the asphaltene-like compounds. In at least one embodiment, other molecules such as polynuclear aromatics can be adsorbed on the carbon material.

In at least one embodiment of the present invention, carbon 108 can be pretreated by heating under an inert gas to a temperature above about 500° C.

As noted herein, the metals or metal compounds are present in the asphaltene fraction of petroleum feedstock 120 and decompose under supercritical reaction conditions. In at least one embodiment, the metals or metal compounds can be converted to metal oxides or metal hydroxides and can still be adsorbed by the carbon materials. In at least one embodiment of the present invention, carbon 108 traps metals produced from the decomposition of metal porphyrins.

Examples of carbon materials include carbon black, activated carbon, and combinations thereof. In at least one embodiment of the present invention, carbon 108 includes carbon black. Advantageously, mixing the carbon materials of carbon 108 with petroleum in upgraded stream 140 under supercritical conditions advantageously allows for selective adsorption of metal compounds onto the surface of the carbon materials over non-metal compounds and as compared to carbon materials at subcritical conditions. Without being bound to a particular theory, it is understood that the high solubility of supercritical water prevents adsorption of non-metal compounds, thus favoring the adsorption of metals. The interaction between carbon materials and metals is in the absence of reactions. The presence of carbon 108 does not produce a catalytic effect in second supercritical water reactor 45 and no reactions take place between the carbon materials and the petroleum products and compounds present in diluted carbon dispersed stream 144. Carbon 108 is in the absence of catalytic material.

Carbon 108 can include a carbon material in the form of carbon particles having a particle diameter, a surface area, and a carbon content. In at least one embodiment, carbon 108 is carbon black in the form of carbon particles. In at least one embodiment, carbon 108 is activated carbon in the form of carbon particles. In at least one embodiment, carbon 108 is a mix of carbon black and activated carbon in the form of particles, where a mix of carbon black particles, activated carbon particles, and mixed carbon black-activated carbon particles can be present.

The carbon particles can be micro-sized particles, where the micro-sized particles have a secondary particle size of less than 10 micrometers, alternately less than 8 micrometers, alternately less than 6 micrometers, and alternately between 5 micrometers and 1 micrometer. As used herein, "secondary particle size" refers to an average diameter or dimension (when the aggregate is not spheroidal or roughly spheroidal) of an aggregate of carbon particles. The term carbon particles encompasses in its meaning an aggregate of particles, unless otherwise indicated. One of skill in the art will understand that the carbon particles of carbon materials, such as carbon black can be referred to by two sizes: primary particle size and secondary particle size. As used herein, "primary particle size" refers to the average diameter of the individual particles and can be measured by electron microscope. Secondary particle size refers to the size of the aggregates. As described in ASTM D3053, *Standard Terminology Relating to Carbon Black*, "carbon black exhibits morphology composed of spheroidal 'primary particles' strongly fused together to form discrete entities called aggregates. The primary particles are conceptual in nature, in that once the aggregate is formed the 'primary particle' no longer exists, they are no longer discrete and have no physical boundaries amongst them. The aggregates are loosely held together by weaker forces forming larger entities called agglomerates. The agglomerates will break down into aggregates if adequate force is applied (e.g., shear force). Aggregates are the smallest dispersible unit. Carbon black is placed on the market in the form of agglomerates." As noted by the International Carbon Black Association, *Factsheet: Particle Properties of Carbon Black*, "aggregates are robust structures, able to withstand shear forces; they are the smallest dispersible units measuring from about 80 to about 800 nm." Secondary particle size can be determined according to any known method. For example, one method to determine average diameter is the laser diffraction method. Carbon particles are dispersed in liquid, such as water, with aid of a dispersant, such as a surfactant. A laser is irradiated and the scattered pattern is recorded to estimate the particle size distribution. The laser diffraction method is a good method to use to determine optimum dispersant and aggregate size. In the laser diffraction method, all particles are assumed to be spherical. The result from the laser diffraction method is the sphere equivalent diameter. The laser diffraction instrument is first calibrated with "spherical" standard powder. "Calibration" is used to correlate the scattered pattern and the size of the "spherical" powder. After calibration, the real sample is measured and the sphere equivalent diameter is determined. In at least one embodiment, the laser diffraction method is used to measure secondary particle size. Thus even where the carbon particles are not spherical one of skill in the art can determine a diameter. Without being bound to a particular theory, secondary particle sizes above 1 micrometer are desired because below 1 micrometer the carbon particles are difficult to separate from the liquid fluid. Secondary particle sizes below 10 micrometers are desired because secondary particle sizes above 10 micrometers can cause the process lines, including valves in the process lines to plug. For example, secondary particle sizes above 10 micrometers can cause pressure control valves to plug, because pressure control valves have a small orifice which is vulnerable to plugging by particles. In at least one embodiment of the present invention, carbon 108 includes carbon particles having a particle diameter between 1 micrometer and 5 micrometers. The carbon particles can have a surface area greater than 25 square meters per gram ($m^2/g$), alternately greater than 50 $m^2/g$, alternately greater than 75 $m^2/g$, alternately greater than 100 $m^2/g$, and alternately greater than 125 $m^2/g$. In at least one embodiment of the present invention, the carbon particles have a surface area greater than 100 $m^2/g$. In at least one embodiment of the present invention, the carbon particles have a surface area of 110 $m^2/g$. The carbon particles can contain other compounds, where they have a carbon content. The carbon content of the carbon particles is at least 80 wt % carbon, alternately at least 85 wt %, alternately at least 90 wt %, alternately at least 95 wt %, alternately at least 97 wt %, and alternately between 97 wt % and 99 wt %. Without being bound to a particular theory, carbon content below 80 wt % carbon reduces the efficiency of the carbon particles ability to trap metals.

In at least one embodiment of the present invention, carbon 108 includes carbon black carbon particles having a primary particle size of 0.024 microns, a specific surface area of 110 $m^2/g$, and a carbon content of between 97 and 99 wt %. Carbon 108 containing carbon black can be mixed with make-up water 104 at a rate of 25 grams of carbon black per 1 liter (L) of water.

Carbon 108 is in the absence of alumina. Without being bound to a particular theory, it is understood that alumina has a low hydrothermal stability causing disintegration of alumina and re-agglomeration, the re-agglomeration can create particles that plug the process lines.

Carbon 108 and carbon dispersal zone 32 are in the absence of a fixed bed. The carbon material through carbon 108 and carbon dispersal zone 32 remains dispersed in the fluid through make-up mixing zone 35, second supercritical water reactor 45, and cooling device 50, until filtered from the liquid fluids by filtering element 90, as discussed herein.

In some embodiments of the present invention, a dispersal surfactant can be added to increase the dispersal of carbon in carbon dispersal zone 32. The dispersal surfactant can be any surfactant capable of increasing the ability of the carbon materials to disperse in make-up water stream 104 and to minimize the aggregation of carbon materials. Examples of surfactants include an acrylic-resin based surfactant. In at least one embodiment, second supercritical water reactor 45 is in the absence of direct injection of solid carbon materials. Without being bound to a particular theory, the high pressure conditions in second supercritical water reactor 45 make it unfeasible to directly inject solid carbon materials.

In at least one embodiment of the present invention, carbon 108 can be mixed with make-up stream 100 upstream of make-up pump 5 and make-up heater 2 (not shown). Make-up stream 100 with carbon dispersed is then pressurized in make-up pump 5 and heated in make-up heater 2 to a temperature and pressure above the critical point of water to produce carbon dispersed water stream 132.

Carbon dispersed water stream 132 contains a quantity of carbon in the range of about 0.01 percent by weight (wt %) petroleum feedstock 120 to about 1.0 wt % petroleum feedstock 120, alternately in the range of about 0.05 wt % petroleum feedstock 120 to about 0.1 wt % petroleum feedstock 120, alternately in the range of about 0.1 wt % petroleum feedstock 120 to about 0.2 wt % petroleum feedstock 120, alternately in the range of 0.2 wt % petroleum feedstock 120 to about 0.3 wt % petroleum feedstock 120, alternately in the range of 0.3 wt % petroleum feedstock 120 to about 0.4 wt % petroleum feedstock 120, alternately in the range of about 0.4 wt % petroleum feedstock 120 to about 0.5 wt % petroleum feedstock 120, alternately in the range of about 0.5 wt % petroleum feedstock 120 to about 0.6 wt % petroleum feedstock 120, alternately in the range of about 0.6 wt % petroleum feedstock 120 to about 0.7 wt % petroleum feedstock 120, alternately in the range of about 0.7 wt % petroleum feedstock 120 to about 0.8 wt % petroleum feedstock 120, alternately in the range of about 0.8 wt % petroleum feedstock 120 to about 0.9 wt % petroleum feedstock 120, and alternately in the range of about 0.9 wt % petroleum feedstock 120 to about 1.0 wt % of petroleum feedstock 120. In at least one embodiment of the present invention, carbon dispersed water stream 132 contains a quantity of carbon in the range of about 0.05 wt % petroleum feedstock 120 to about 1 wt % petroleum feedstock 120. In at least one embodiment of the present invention, the carbon material is mixed with make-up water stream 104 so that the amount of carbon is between 0.1 wt % of water and 5 wt % of water. The ratio of the total weight of carbon material in carbon dispersed water stream 132 is related to the total amount of petroleum feedstock 120, because the carbon material is added for the purpose to trap metal compounds, therefore the amount of carbon material added is relative to the petroleum feedstock and measure of metal content therein.

In at least one embodiment, carbon dispersed water stream 132 is transferred from carbon dispersal zone 32 to make-up mixing zone 35 in a pipe with an inner diameter small enough to maintain a superficial velocity that prevents precipitation of the dispersed carbon materials from the water. The desired superficial velocity is determined by the size and concentration of carbon materials, such as carbon particles. The desired superficial velocity can be measured separately by monitoring accumulation of carbon materials in the line.

The carbon materials can begin to trap metal compounds in make-up mixing zone 35, however the reduced pressure of second supercritical water reactor 45 can result in the metal compounds being more easily adsorbed on the carbon materials in second supercritical water reactor 45.

Carbon dispersed water stream 132 is mixed with upgraded stream 140, described herein with reference to FIG. 3 in make-up mixing zone 35 to produce diluted carbon dispersed stream 144. Diluted carbon dispersed stream 144 is injected into second supercritical water reactor 45 to produce carbon dispersed effluent stream 148.

In second supercritical water reactor 45, the carbon materials present in diluted carbon dispersed stream 144 trap metals. The carbon materials trap metals more effectively at supercritical water conditions than at subcritical conditions.

Carbon dispersed effluent stream 148 is passed to filter cooling device 55 to produce cooled carbon dispersed effluent 154. Filter cooling device 55 can be any type of cooling device capable of reducing the temperature of carbon dispersed effluent stream 148. In at least one embodiment of the present invention, filter cooling device 55 is a heat exchanger. Cooled carbon dispersed effluent 154 is at a temperature below the critical temperature of water, alternately below 300° C., alternately below 275° C., alternately below 250° C., and alternately below 225° C. Cooled carbon dispersed effluent 154 is introduced to filtering element 90. In at least one embodiment, cooled carbon dispersed effluent 154 is kept at a temperature above 50° C. to avoid a large pressure drop in filtering element 90.

Filtering element 90 is any static device capable of separating out the carbon materials with trapped metals from the liquid fluids in cooled carbon dispersed effluent 154. Exemplary devices include a filter unit, a centrifuge, and other methods known in the art to remove solid micro-sized particles from a liquid fluid. Filtering element 90 produces used carbon 190 and filtered stream 152. In at least one embodiment, a system with filtering element 90 removing the carbon materials with trapped metals requires less energy than a conventional filter removing the metal particles alone. Filtering metal particles alone requires very fine filters due to the size of the metal particles. Because the carbon materials with trapped metals are larger than the metal particles alone, larger filters can be used in filtering element 90 as compared to a conventional filter. A system with filtering element 90 requires less energy because a lower pressure drop occurs across the filter due to the larger size than compared to a conventional filter removing metal particles alone.

Used carbon 190 contains the carbon materials with trapped metals separated from cooled carbon dispersed effluent 154. Used carbon 190 can be sent to a unit for further processing or can be disposed of. In at least one embodiment, the unit for further processing is a combustion unit. In the combustion unit, the carbon materials with trapped metals are combusted to release the metals, which can subsequently be recovered. This combustion unit operates at a lower range of combustion (for example, lower than combustion in a gas turbine) to minimize corrosion of the equipment due to the metals. The recovered metals can be sold. In at least one embodiment of the present invention, used carbon 190 is in the absence of a recycling line or process. Metal compounds remaining on the carbon materials after being separated are not easily removed to recapture the native carbon materials and would reduce the efficiency of the carbon material in carbon 108 if recycled.

Advantageously, the trapping of metals and metal compounds, including in the form of metal oxides and metal hydroxides, on the carbon materials facilitates separation by filtering. In the absence of carbon materials, the size of the metals and metal compounds is too small and too low of a concentration to be effectively filtered. In at least one embodiment, the concentration of metal and metal compounds in cooled carbon dispersed effluent 154 is less than 10 ppm by weight, whereas the concentration of carbon material is between 0.001 wt % and 1 wt % of the crude oil.

Filtering element 90 can be a series of filter units each having a different filter size and efficiency. Filtering element 90 is in the absence of an internal agitator.

Filtered stream 152 can be in the absence of carbon materials with trapped metals. In an embodiment, filtered stream 152 includes an amount of carbon materials with trapped metals that can be concentrated in water-phase product 172 following separation in separator unit 70. In at least one embodiment, water-phase product 172 that contains carbon materials with trapped metals can be further processed to separate the remaining carbon materials from the water. In at least one embodiment, the further processing includes separation of the carbon materials with trapped metals from the water using a filtration unit.

Filtered stream 152 passes through cooling device 50 to produce cooled stream 150. Cooling device 50 is described with reference to FIG. 2. Cooled stream 150 is at a temperature below the temperature of cooled carbon dispersed effluent 154, alternately below 300° C., alternately below 275° C., alternately below 250° C., alternately below 225° C., alternately below 200° C. and alternately below 150° C. In at least one embodiment of the present invention, cooled stream 150 is at a temperature of 50° C. Cooled stream 150 is passed to pressure let-down device 60 as described with reference to FIG. 2.

In certain embodiments of the present invention, the process for upgrading hydrocarbons as shown in FIG. 3, filtering element 90 can be at any point downstream of second supercritical water 45. In certain embodiments, the process for upgrading hydrocarbon, as shown in FIG. 3 with carbon 108, is in the absence of filtering element 90 upstream of separator unit 70. Carbon dispersed effluent stream 148 is cooled and depressurized to a temperature below 50° C. and a pressure less than 0.1 MPa and then fed to separator unit 70. Following separation in separator unit 70, the carbon materials are concentrated in water-phase product 172. In at least one embodiment of the present invention, a centrifuge can be part of filtering element 90, to increase the concentration of carbon material in water-phase product 172. Water-phase product 172 can be further processed to separate the carbon materials from the water so the water can be recycled in the process. In some embodiments of the present invention, where the process is in the absence of a filtering element, carbon materials with trapped metals present in residue product 185 can be combusted to generate energy and recover valuable metals in the form of metal oxides. In at least one embodiment of the present invention, residue product 185 is in the absence of a recycling line or process. Metal compounds remaining on the carbon materials after being separated are not easily removed to recapture the native carbon materials and would reduce the efficiency of the carbon material in carbon 108.

Figure 4:
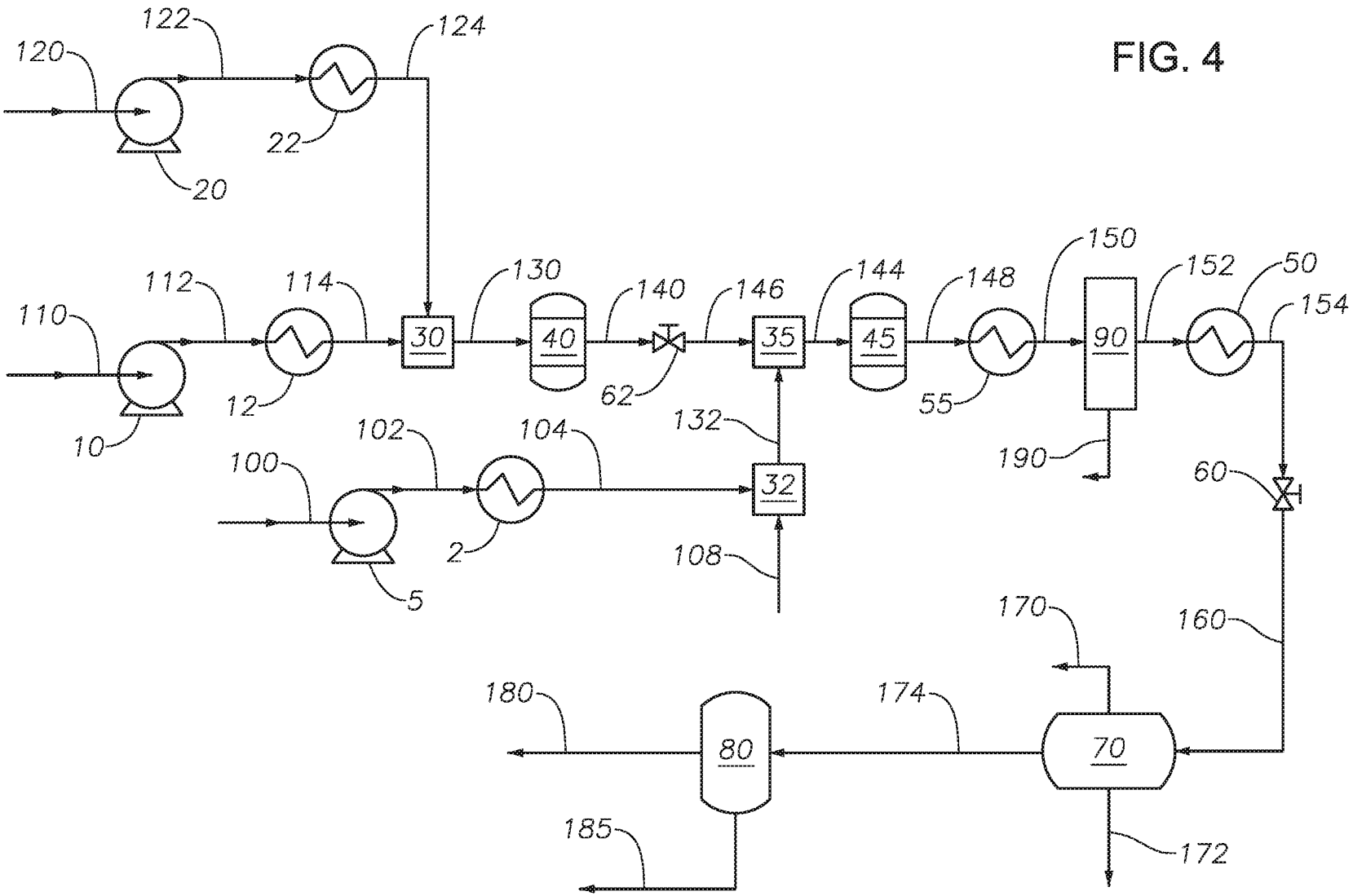
FIG. 4 provides a process diagram of one embodiment of the process of upgrading a hydrocarbon feedstock according to the present invention.

FIG. 4 discloses an alternate embodiment of the present invention. With reference to the process and method as described in FIGS. 2 and 3, upgraded stream 140 passes through pressure control device 62 to produce depressurized upgraded stream 146. Pressure control device 62 can be any type of pressure regulator capable of providing a pressure drop for reducing the pressure of upgraded stream 140. Exemplary pressure control device 62 include pressure control valve and flow restrictor. In embodiments of the present invention, the pressure of first supercritical water reactor 40 and the pressure of second supercritical water reactor 45 can be the same. In embodiments of the present invention, the pressure of first supercritical water reactor 40 can be greater than the pressure of second supercritical water reactor 45. The pressure in second supercritical water reactor 45 cannot be greater than the pressure in first supercritical water reactor 40. The pressure in second supercritical water reactor 45 is lower than the pressure in first supercritical water reactor 40 in order to reduce solubility of large molecules, such as asphaltene or asphaltene-like compounds for enhancing adsorption of such heavy molecules on the carbon material. Pressure control device 62 can be designed to have a pressure drop of at least about 0.1 MPa, alternately of at least about 0.2 MPa, alternately of at least of about 0.5 MPa, alternately of at least about 1.0 MPa, alternately of at least about 1.5 MPa, and alternately of about 2.0 MPa. In at least one embodiment of the present invention, the pressure drop across pressure control device 62 does not exceed 2.0 MPa. Advantageously, maintaining a pressure drop of less than 2 MPa enhances the ability to control the operating conditions in both first supercritical reactor 40 and second supercritical reactor 45. Pressure control device 62 is designed to have a pressure drop in consideration of the fact that depressurized upgraded stream 146 should be maintained at a pressure above the critical pressure of water. Depressurized upgraded stream 146 is introduced to make-up mixing zone 35 to be mixed with carbon dispersed water stream 132 to produce diluted carbon dispersed stream 144.

An advantage of the present invention is to convert residue streams, such as atmospheric residue streams and vacuum residue streams, to product streams suitable for use in power generation and high grade coke production.

The number of supercritical water reactors employed in the process of the present invention varies based on the design needs of the process. The process to remove metals and sulfur from a heavy fraction hydrocarbon stream can include two supercritical water reactors arranged in series, alternately three supercritical water reactors arranged in series, alternately four supercritical water reactors arranged in series, and alternately more than four supercritical water reactors arranged in series. In a preferred embodiment of the present invention, two supercritical water reactors are arranged in series. In embodiments that employ more than two supercritical water reactors, the make-up water stream or alternately, the carbon dispersed water stream can be injected into any reactor except the first reactor in series. The first supercritical water reactor in series is in the absence of carbon materials because the metal containing asphaltenes can be trapped on the carbon materials and no further reaction of the metal containing asphaltenes would occur, as a result valuable petroleum components would not be recovered, because the valuable petroleum components are recovered by the metal containing asphaltenes undergoing cracking reactions. The make-up water stream is added following the first supercritical water reactor in series so that the first supercritical water reactor is not diluted to the extent that radicals formed in the upgrading reactions cannot be propagated. In other words, additional water is needed for the second or any subsequent supercritical water reactors in series, but the entire volume of water needed for the process cannot be added upstream of the first supercritical water reactor because then the first supercritical water reactor would be overly diluted and the radicals formed during upgrading reactions would not propagate as needed. In at least one embodiment, with more than two supercritical water reactors in series, make-up water is added upstream of each second or subsequent supercritical water reactor, for example, between the first supercritical water reactor and second supercritical water reactor and between the second supercritical water reactor and third supercritical water reactor.

The residence time in any subsequent supercritical water reactor in series (following the second supercritical water reactor) can have a residence time between longer than about 10 seconds, alternately between about 10 seconds and about 5 minutes, alternately between about 10 seconds and 10 minutes, alternately between about 1 minute and about 6 hours, and alternately between about 10 minutes and 2 hours. In at least one embodiment of the present invention, catalyst can be added to first supercritical water reactor 40 to catalyze the conversion reactions. In at least one embodiment of the present invention, catalyst can be added to catalyze cracking and facilitate hydrogen transfer from one molecule to another in first supercritical water reactor 40. Any catalyst capable of catalyzing a conversion reaction can be used. Examples of catalysts can include metal oxide based catalysts, such as transition metal oxides, and metal based catalysts, such as precious metals. Catalyst supports can include alumina, silica, silica-alumina, and zeolites. In at least one embodiment, a catalyst is in the absence of alumina because gamma-alumina can disintegrate in supercritical water. In at least one embodiment of the present invention, vanadium present in the mixed stream can act as a catalyst. In at least one embodiment of the present invention, first supercritical water reactor 40 is in the absence of catalyst. First supercritical water reactor 40 is in the absence of externally supplied hydrogen. First supercritical water reactor 40 is in the absence of an externally supplied oxidizing agent. In at least one embodiment of the present invention, the operating conditions of supercritical water reactor: temperature, pressure, and residence time, are designed to reduce or minimize the production of solid coke, while concentrating converted metals in the asphaltene fraction.

EXAMPLE

Comparative Example

Simulation Scheme 1: a process simulation of a single reactor. A petroleum feedstock of crude oil at a flow rate of 1,000 barrels per day was heated to a temperature of 150° C. and pressurized to a pressure of 25 MPa to produce a heated, pressurized petroleum stream. A water stream was heated to a temperature of 450° C. and a pressure of 25 MPa, making the stream a supercritical water stream. The heated, pressurized petroleum stream and supercritical water stream were mixed in a mixing zone. The volumetric ratio of flow rate of petroleum feedstock to water at feed conditions was 1 to 2. The operating conditions of the feed streams are in Table 1. The heated, pressurized streams and supercritical water stream were mixed in the mixing zone to produce a mixed stream. The mixed stream was fed to a supercritical water reactor. The supercritical water reactor was set to have conditions such that the product effluent stream was at a temperature of 450° C. and pressure of 25 MPa. The product effluent was cooled to 50° C. according to a cooling device. The cooled stream was depressurized to a pressure of 0.11 MPa according to a pressure letdown device and fed to a separator unit. The separator unit was simulated to separate the cooled, depressurized stream into a gas-phase product stream, a liquid petroleum product, and a water phase product stream. Liquid yield was 97.0 wt %. Liquid yield is equal to the weight of liquid petroleum product divided by the weight of petroleum feedstock. The gas yield was about 3.0 wt %. The properties of the petroleum feedstock compared to the liquid petroleum product are in Table 2.

TABLE 1

Composition and Properties of Feed Streams for Simulation Scheme 1

| | Crude Oil Feedstock | Water | Heated, pressurized petroleum stream | Super-critical water stream |
|---|---|---|---|---|
| Temperature (° C.) | 15 | 15 | 150 | 450 |
| Pressure (MPa) | 0 | 0 | 25 | 25 |
| Flow Rate (barrel/day) | 1000 | 2000 | — | — |

TABLE 2

Composition and Properties of Petroleum Streams for Simulation Scheme 1

| | Specific Gravity (API) | Total Sulfur (wt %) | Vanadium (wt ppm) | Asphalthene (wt %) |
|---|---|---|---|---|
| Petroleum Feedstock | 32 | 1.9 | 13.0 | 3.0 |
| Liquid Petroleum Product | 35 | 1.5 | 3.0 | 0.6 |

Simulation Scheme 2: a process simulation with two reactors in series. A petroleum feedstock of crude oil at a flow rate of 1,000 barrels per day was heated to a temperature of 150° C. and pressurized to a pressure of 25 MPa to produce a heated, pressurized petroleum stream. A water stream was heated to a temperature of 450° C. and a pressure of 25 MPa, making the stream a supercritical water stream. The heated, pressurized petroleum stream and supercritical water stream were mixed in a mixing zone. The volumetric flow rate ratio of petroleum feedstock to water at feed conditions was 1 to 1. The operating conditions of the feed streams are in Table 3. The heated, pressurized streams and supercritical water stream were mixed in the mixing zone to produce a mixed stream. The mixed stream was fed to a first supercritical water reactor. The first supercritical water reactor was set to have conditions such that the upgraded stream exiting the first supercritical water reactor was at a temperature of 450° C. and pressure of 25 MPa. A second water stream at a flow rate of 1000 barrels/day was heated to a temperature of 450° C. and pressurized to a pressure of 25 MPa to produce a make-up water stream. The make-up water stream was mixed with the upgraded stream in a mixer to produce a diluted stream. The pressure drop across the mixer was set to be 0.5 MPa, such that the pressure of the diluted stream was 24.5 MPa entering a second supercritical water reactor. The second supercritical water reactor was designed in the simulation to have conditions such that the product effluent stream exiting the second supercritical water reactor was at a temperature of 450° C. and pressure of 25 MPa. The product effluent was cooled to 50° C. according to a cooling device. The cooled stream was depressurized to a pressure of 0.11 MPa according to a pressure letdown device and fed to a separator unit. The separator unit was simulated to separate the cooled, depressurized stream into a gas-phase product stream, a liquid petroleum product, and a water phase product stream. Liquid yield was 96.0 wt %. Liquid yield is equal to the weight of liquid petroleum product divided by the weight of petroleum feedstock. The gas yield was about 4.0 wt %. The properties of the petroleum feedstock compared to the liquid petroleum product are in Table 4. While the liquid yield is lower than in Scheme 1, the sulfur and vanadium contents are also lower.

TABLE 3

Composition and Properties of Feed Streams for Simulation Scheme 2

| | Crude Oil Feedstock | Water | Heated, pressurized petroleum stream | Super-critical water stream | Make-up Water |
|---|---|---|---|---|---|
| Temperature (° C.) | 15 | 15 | 150 | 450 | 450 |
| Pressure (MPa) | 0 | 0 | 25 | 25 | 25 |
| Flow Rate (barrel/day) | 1000 | 1000 | — | — | — |

TABLE 4

Composition and Properties of Petroleum Streams for Simulation Scheme 2

| | Specific Gravity (API) | Total Sulfur (wt %) | Vanadium (wt ppm) | Asphalthene (wt %) |
|---|---|---|---|---|
| Petroleum Feedstock | 32 | 1.9 | 13.0 | 3.0 |
| Liquid Petroleum Product | 36 | 1.3 | 1.0 | 0.4 |

Simulation Scheme 3: a process simulation with two reactors in series and addition of carbon. A petroleum feedstock of crude oil at a flow rate of 1,000 barrels per day was heated to a temperature of 150° C. and pressurized to a pressure of 25 MPa to produce a pre-heated petroleum feedstock. A water stream was heated to a temperature of 450° C. and a pressure of 25 MPa to produce a pre-heated water stream, making the pre-heated water stream a supercritical water stream. The volumetric ratio of flow rate of petroleum feedstock to water at feed conditions was 1 to 1. The operating conditions of the feed streams are in Table 5.

The pre-heated petroleum feedstock and pre-heated water stream were mixed in a mixing zone to produce a mixed stream. The mixed stream was fed to a first supercritical water reactor. The first supercritical water reactor was set to have conditions such that the upgraded stream exiting the first supercritical water reactor was at a temperature of 450° C. and pressure of 25 MPa. A second water stream at a flow rate of 1000 barrels/day was heated to a temperature of 450° C. and pressurized to a pressure of 25 MPa to produce a make-up water stream. Carbon in the form of carbon black having a particle size of 0.024 μm and a specific surface area of 110 $m^2/g$ was dispersed within the make-up water stream at a rate of 250 grams of carbon per one liter of make-up water to produce a carbon dispersed water stream. In the simulation of Scheme 3, the carbon added to the make-up water was simulated to be 0.2 wt % of the petroleum feedstock. The carbon containing water stream was mixed with the upgraded stream in a mixer to produce a diluted carbon dispersed stream. The pressure drop across the mixer was set to be 0.5 MPa, such that the pressure of the diluted stream was 24.5 MPa entering a second supercritical water reactor. The second supercritical water reactor was designed in the simulation to have conditions such that the product effluent stream exiting the second supercritical water reactor was at a temperature of 450° C. and pressure of 25 MPa. The product effluent was cooled to 250° C. according to a cooling device. The cooled stream was fed to a filtering element to separate the carbon and produce a filtered stream. The filtered stream was cooled to a temperature of 50° C. and then depressurized to a pressure of 0.11 MPa according to a pressure letdown device and fed to a separator unit. The separator unit was simulated to separate the cooled, depressurized stream into a gas-phase product stream, a liquid petroleum product, and a water phase product stream. Carbon not removed in the filtering element remains in the water phase product. Liquid yield was 96.5 wt %. Liquid yield is equal to the weight of liquid petroleum product divided by the weight of petroleum feedstock. The gas yield was about 3.0 wt %. Approximately 0.5 wt % of the hydrocarbons was removed with the carbon from the filtering element. Loss of hydrocarbons to the water phase product was negligible. The properties of the petroleum feedstock compared to the liquid petroleum product are in Table 6. While the liquid yield is higher than in Scheme 2, but lower than in Scheme 1. The sulfur and vanadium contents are also lower.

TABLE 5

Composition and Properties of Feed Streams for Simulation Scheme 3

| | Crude Oil Feedstock | Water | Heated, pressurized petroleum stream | Super-critical water stream | Make-up Water |
|---|---|---|---|---|---|
| Temperature (° C.) | 15 | 15 | 150 | 450 | 450 |
| Pressure (MPa) | 0 | 0 | 25 | 25 | 25 |
| Flow Rate (barrel/day) | 1000 | 1000 | — | — | — |

TABLE 6

Composition and Properties of Petroleum Streams for Simulation Scheme 3

| | Specific Gravity (API) | Total Sulfur (wt %) | Vanadium (wt ppm) | Asphalthene (wt %) |
|---|---|---|---|---|
| Petroleum Feedstock | 32 | 1.9 | 13.0 | 3.0 |
| Liquid Petroleum Product | 36 | 1.1 | 0.3 | 0.4 |

TABLE 7

Composition and Properties of Liquid Petroleum Product for all three Schemes

| | Liquid Yield | Specific Gravity (API) | Total Sulfur (wt %) | Vanadium (wt ppm) | Asphalthene (wt %) |
|---|---|---|---|---|---|
| Scheme 1 | 97.0% | 35 | 1.5 | 3.0 | 0.6 |
| Scheme 2 | 96.0% | 36 | 1.3 | 1.0 | 0.4 |
| Scheme 3 | 96.5% | 36 | 1.1 | 0.3 | 0.4 |

The results show that the present invention, represented by scheme 2 and scheme 3, can achieve vanadium removal, such that the vanadium concentration is less than 1 ppm by weight while maintaining a high liquid yield as compared to a conventional hydrodemetallization process or SDA process (SDA process can have as high as 75% liquid yield). In addition, hydrodemetallization processes require expensive equipment and have high operating costs due to the hydrogen and catalyst requirements. Thus, scheme 2 and scheme 3 illustrate that the present process can provide a way of achieving metals removal at a lower economic cost. Not to mention, lower sulfur concentration and asphalthene concentration also.

The results show that the process of the present invention can achieve a liquid yield of 96.0% or greater and can result in a product with equal to or less than 1.0 wt ppm vanadium less than 1.5 wt % sulfur using only reactor units in the absence of catalyst.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

There various elements described can be used in combination with all other elements described herein unless otherwise indicated.

The singular forms "a", "an" and "the" include plural referents, unless the context clearly dictates otherwise.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

Throughout this application, where patents or publications are referenced, the disclosures of these references in their entireties are intended to be incorporated by reference into this application, in order to more fully describe the state of the art to which the invention pertains, except when these references contradict the statements made herein.

As used herein and in the appended claims, the words "comprise," "has," and "include" and all grammatical variations thereof are each intended to have an open, non-limiting meaning that does not exclude additional elements or steps.

As used herein, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present invention.

That which is claimed is:

1. A system to selectively remove metal compounds and sulfur from a petroleum feedstock, the system comprising:

a mixing zone, the mixing zone configured to mix a pre-heated water stream and a pre-heated petroleum feedstock to form a mixed stream, wherein the pre-heated water stream is at a temperature above the critical temperature of water and at a pressure above the critical pressure of water, wherein the pre-heated petroleum feedstock is at a temperature of less than 150° C. and at a pressure above the critical pressure of water, wherein the pre-heated petroleum feedstock comprises a petroleum feedstock, wherein the petroleum feedstock comprises metals, wherein the metals comprise metal porphyrins;

a first supercritical water reactor fluidly connected to the mixing zone, the first supercritical water reactor configured to allow conversion reactions to occur to produce an upgraded stream, the first supercritical water reactor at a pressure above the critical pressure of water and at a temperature above the critical temperature of water, the first supercritical water reactor in the absence of externally provided hydrogen, wherein metal porphyrins are operable to decompose in the first supercritical water reactor to produce metals;

a carbon dispersal zone, the carbon dispersal zone configured to mix carbon with a make-up water stream to produce a carbon dispersed water stream, wherein the carbon comprises a carbon material, wherein the carbon is present in a range of between 0.05 wt % of the petroleum feedstock and 1.0 wt % of the petroleum feedstock, wherein the carbon dispersed water stream is at a temperature above the critical temperature of water and a pressure above the critical pressure of water, wherein the carbon dispersal zone is in the absence of a fixed bed, such that the carbon is dispersed in the carbon dispersed water stream, wherein the carbon is in the absence of catalytic material;

a make-up mixing zone fluidly connected to the first supercritical water reactor and the carbon dispersal zone, the make-up mixing zone configured to combine the upgraded stream and the carbon dispersed water stream to produce a diluted carbon dispersed stream, wherein the carbon dispersed water stream is above the critical temperature of water and above the critical pressure of water, wherein the carbon dispersed water stream increases a volumetric flow rate ratio of water to oil in the diluted carbon dispersed stream as compared to the upgraded stream, wherein the carbon is dispersed in the diluted carbon dispersed stream, wherein the carbon is operable to trap metals present in the upgraded stream; and a second supercritical water reactor fluidly connected to the make-up mixing zone, the second supercritical reactor configured to allow conversion reactions to occur to produce a carbon dispersed effluent stream, wherein the second supercritical water reactor is at a pressure between the critical pressure of water and the pressure in the first supercritical water reactor, wherein a temperature in the second supercritical water reactor is at least the same as the temperature in the first supercritical water reactor.

2. The system of claim 1, further comprising:

a filter cooling device fluidly connected to the second supercritical water reactor, the filter cooling device configured to reduce a temperature of the carbon dispersed effluent stream to produce a cooled carbon dispersed effluent, wherein the cooled carbon dispersed effluent is at a temperature below 225° C.; and a filtering element fluidly connected to the filter cooling device, the filtering element configured to separate the carbon from the cooled carbon dispersed effluent to produce a used carbon and a filtered stream.

3. The system of claim 2, further comprising:

a cooling device fluidly connected to the filtering element, the cooling device configured to reduce a temperature of the filtered stream to produce a cooled stream;

a pressure let-down device fluidly connected to the cooling device, the pressure let-down device configured to reduce a pressure of the cooled stream to produce a depressurized stream;

a separator unit fluidly connected to the pressure let-down device, the separator unit configured to separate the depressurized stream to produce a gas-phase product, a water-phase product and a liquid petroleum product; and a hydrocarbon separator fluidly connected to the separator unit, the hydrocarbon separator configured to separate the liquid petroleum product to produce a light oil product and a residue product.

4. The system of claim 1, wherein the carbon material is selected from the group consisting of carbon black, activated carbon, and combinations of the same.

5. The system of claim 4, wherein the carbon material comprises carbon particles.

6. The system of claim 5, wherein the carbon particles have a particle diameter of less than 10 micrometers.

7. The system of claim 5, wherein the carbon particles have a carbon content of at least 80 wt %.

8. The system of claim 1, wherein the petroleum feedstock is a petroleum-based hydrocarbon selected from the group consisting of whole range crude oil, reduced crude oil, fuel oil, refinery streams, residues from refinery streams, cracked product streams from crude oil refinery, streams from steam crackers, atmospheric residue streams, vacuum residue streams, coal-derived hydrocarbons, and biomass-derived hydrocarbons.

9. The system of claim 1, wherein a ratio of a volumetric flow rate of petroleum feedstock to water entering the first supercritical water reactor is between 1:10 and 1:0.1.

10. The system of claim 1, further comprising:

a pressure control device, the pressure control device configured to reduce a pressure of the upgraded stream to produce a depressurized upgraded stream, wherein a pressure of the depressurized upgraded stream is less than a pressure of the upgraded stream, wherein the depressurized upgraded stream is introduced to the make-up mixing zone.

* * * * *